United States Patent [19]

Jefferson

[11] Patent Number: 4,607,624

[45] Date of Patent: Aug. 26, 1986

[54] HEATING PAD AND MASSAGER

[76] Inventor: Valerie Jefferson, 6639 Brampton Ave., Rialto, Calif. 92376

[21] Appl. No.: 763,202

[22] Filed: Aug. 7, 1985

[51] Int. Cl.[4] ..... A61H 21/00

[52] U.S. Cl. ..... 128/24.2; 128/33; 128/399; 219/217; 219/527; 219/528

[58] Field of Search ..... 219/211, 212, 527, 528, 219/529, 549; 128/24 R, 24 A, 24.2, 24.5, 32, 33, 67, 339, 402, 403; D24/36

[56] References Cited

U.S. PATENT DOCUMENTS

| | | | |
|---|---|---|---|
| 3,710,784 | 1/1973 | Taylor | 128/24.2 |
| 3,854,474 | 12/1974 | Carruth | 128/33 |
| 3,957,038 | 5/1976 | Roberts | 128/24 R |
| 4,125,112 | 11/1978 | Weihs | 128/32 |
| 4,159,714 | 7/1979 | Peterson et al. | 128/24.2 |
| 4,279,255 | 7/1981 | Hoffman | 128/402 |
| 4,335,725 | 6/1982 | Geldmacher | 128/399 |
| 4,396,011 | 8/1983 | Mack et al. | 128/24.2 |
| 4,423,308 | 12/1983 | Callaway et al. | 219/217 |
| 4,429,687 | 2/1984 | Friedson et al. | 128/24.2 |
| 4,446,855 | 5/1984 | Friedson | 128/24.2 |

*Primary Examiner*—Volodymyr Y. Mayewsky
*Attorney, Agent, or Firm*—Paul H. Ware

[57] ABSTRACT

A massaging and heating pad combination for application to the body in which both massaging vibration intensity and temperature may be controlled, primarily intended for use in the relief of the pain and discomfort of cramps and muscle tension and other suffering attendant to the menstrual cycle.

4 Claims, 4 Drawing Figures

HEATING PAD AND MASSAGER

BACKGROUND OF THE INVENTION

1. Field of the Invention

This invention relates generally to heating and vibrating massage pads and more particularly to a combination of an adjustable heating pad with an adjustable massage vibrator.

2. Description of the Prior Art

Heating pads for application to the body are known in which the temperature may be adjusted over a range, of values. While these presently-available, temperature-adjustable heating pads afford some relief to the pain of muscle tension and cramps and the discomfort attendant to the menstrual cycle, complete relief is not obtained through their use. In many cases, therefore, the relief obtainable through the use of heating pads is inadequate.

It would thus be a great advantage to the art to provide an improved device for the relief of pain due to tension and other stresses and particularly to provide greater relief to the suffering attendant to menstruation.

Another great advantage to the art would be the provision of such a pain-relieving device in a conveniently portable package.

It would also be a significant advantage to the art to provide a pain-relieving device capable of being powered from commonly available sources.

SUMMARY OF THE INVENTION

It has been determined that the simultaneous application of heat of elevated temperature to the body in combination with gentle vibratory massage affords much greater relief than the application of either of these treatments alone. Therefore, the device contemplated by the present invention combines the two treatment techniques into a single conveniently portable package.

It is thus a general object of this invention to provide an improved massaging and heating device for the relief of pain due to tension and other stresses.

It is also an object of the present invention to provide such a pain-relieving device in a single conveniently portable package.

Another object of this invention is to provide a heating and massaging device that may be operated by means of either alternating or direct current.

With these and other objects in view, the invention subsists in the construction, arrangement and combination of the various parts of the invention, whereby the objects contemplated are attained, as hereinafter set forth, pointed out in the appended claims and illustrated in the attached drawings.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings wherein like reference characters refer to like parts throughout and in which.

DETAILED DESCRIPTION

Although a specific embodiment of the invention will now be described with reference to the drawings, it should be understood that the embodiment shown is by way of example only and merely illustrative of but one of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

Figure 1:
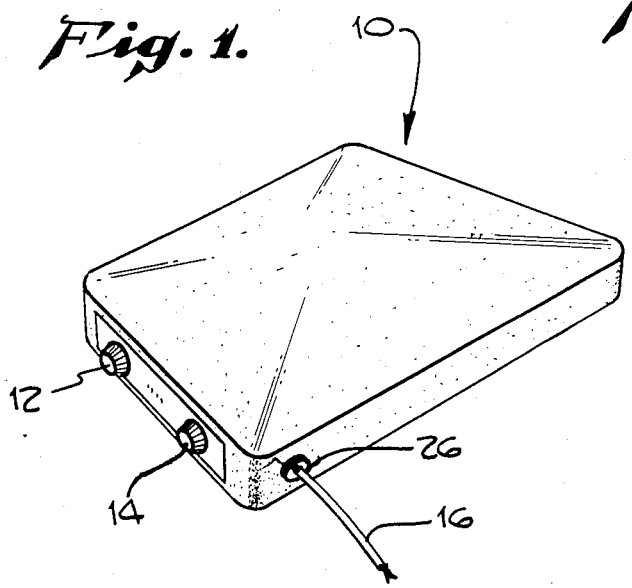
FIG. 1 is an idealized perspective drawing of the heating pad and lower back massager of the invention.

Referring to FIG. 1, with greater particularity, an illustration of the general appearance of a device as contemplated by the invention is denoted generally by the numeral 10. An electric power source cable 16 is shown entering the device through electric source power cable grommet 26. An arrangement of first and second control knobs 12 and 14 respectively is also shown in this figure.

It is contemplated that the device may be powered directly by common household alternating current or, by means of an adapter, (not shown) by twelve-volt automotive power. Such adapters are well known in the art and will not be described further here.

Figure 2:
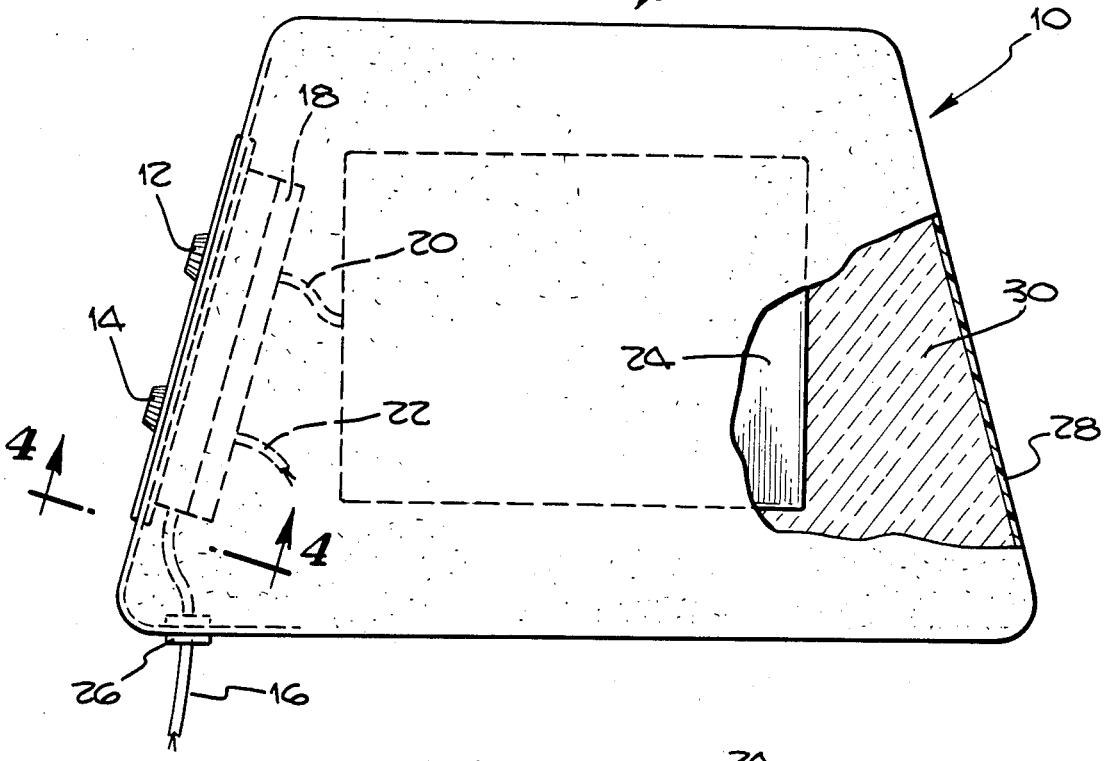
FIG. 2 is a top plan view, partly cutaway to show placement of some internal elements.

Referring now to FIG. 2, electric source power cable 16, entering the device through electric source power cable grommet 26, is shown entering electric junction box 18. It is also shown that control knobs 12 and 14 attach to and are supported upon junction box 18. Lead cable 20 connects from junction box 18 to vibrating massage element or unit 24 while lead cable 22 connects to electric heating element 32. Neither the heating element 32 nor the cable 22 connection is shown in the drawing, however, the connections are entirely conventional. The cutaway shows one view of the pliant, outer covering envelope 28 and the thermal insulating material 30.

Figure 3:
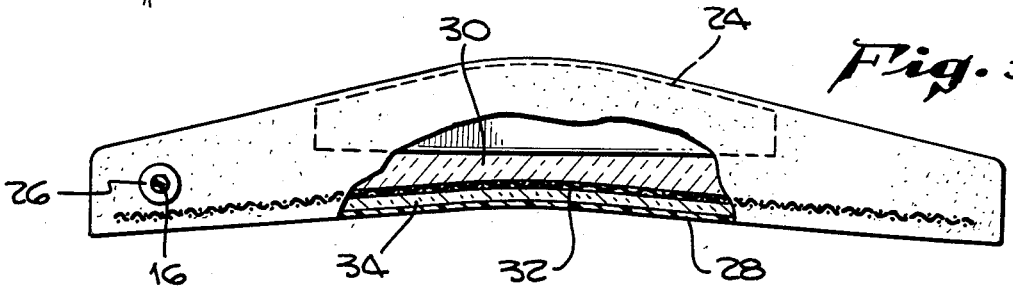
FIG. 3 is a side elevation partly cutaway to show placement of some internal elements.

In FIG. 3, another view of the vibrating massage unit is shown. The contemplated arrangement of the device of pliant, outer covering enevelope 28, exterior to a protective electrical insulation envelope 34 is shown in greater detail. The electric heating element 32 is shown next interiorly to protective electrical insulation envelope 34 after which has been placed a layer of thermal insulating material 30, between the electrical heating element 32 and the vibrating massage unit 24.

Figure 4:
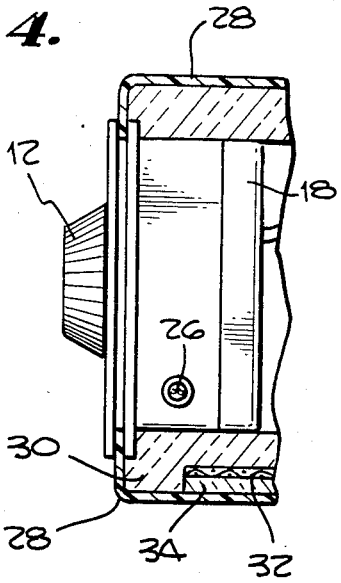
FIG. 4 is a cutaway detail as viewed along the sight lines 4—4 of FIG. 2.

FIG. 4, the detail cutaway cross section as viewed along sight lines 4—4 of FIG. 2, shows the arrangement of the thermal insulation layer 30 as the innermost, then the electric heating element 32 followed by the protective electrical insulating envelope 34 and finally the pliant, outer covering envelope.

Thus, there has been described a heating pad and lower back massager combination that will afford greater relief to the pain and discomfort of tension and stress and to the periodic menstrual suffering than either heating or vibratory massage applied singly. The combination of the two treatments applied simultaneously affords great improvement in efficiency of relief, reliability and flexibility.

It is pointed out that although the present invention has been shown and described with reference to a particular embodiment, nevertheless various changes and modifications, obvious to one skilled in the art to which the invention pertains, are deemed to lie within the purview of the invention.

I claim:

1. In a heating pad and massager, the combination which comprises:

an adjustable electrically activated vibrating massage unit;

means for adjusting said vibrating massage unit;

an adjustable electrically activated heating element;

means for adjusting said heating element;

an electric source power cable for furnishing electric power to said vibrating massage unit and to said heating element;

an electric junction box for connecting said electric source power cable to said vibrating massage unit and to said heating element;

a pliant, outer covering envelope that encloses said vibrating massage unit and said heating element and provides support for said junction box;

a protective electrical insulating envelope situated within said pliant, outer covering envelope and enclosing said vibrating massage unit and said heating element; and a layer of thermal insulating material situated between said vibrating massage unit and said heating element.

2. The heating pad and massager of claim 1 wherein said means for adjusting said vibrating massage unit includes means for adjusting the intensity of vibration.

3. The heating pad and massage unit of claim 2 wherein said means for adjusting said vibrating massage unit includes means for adjusting the frequency of vibration.

4. The heating pad and massage unit of claim 1 wherein said means for adjusting said heating element includes means for adjusting the temperature of said heating element.

* * * * *